US012753759B2

(12) United States Patent
Cho

(10) Patent No.: US 12,753,759 B2
(45) Date of Patent: Oct. 6, 2026

(54) PUMP

(71) Applicant: LG INNOTEK CO., LTD., Seoul (KR)

(72) Inventor: Hyun Shik Cho, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 72 days.

(21) Appl. No.: 18/714,453

(22) PCT Filed: Nov. 16, 2022

(86) PCT No.: PCT/KR2022/018107
§ 371 (c)(1),
(2) Date: May 29, 2024

(87) PCT Pub. No.: WO2023/113259
PCT Pub. Date: Jun. 22, 2023

(65) Prior Publication Data

US 2025/0027494 A1 Jan. 23, 2025

(30) Foreign Application Priority Data

Dec. 15, 2021 (KR) ..... 10-2021-0179512

(51) Int. Cl.
*F04C 15/00* (2006.01)
*F04C 2/10* (2006.01)

(52) U.S. Cl.
CPC ..... *F04C 15/0057* (2013.01); *F04C 2/102* (2013.01); *F04C 2240/40* (2013.01); *F04C 2240/50* (2013.01)

(58) Field of Classification Search
CPC ..... F04C 2240/50; F04C 2240/51; F04C 2240/52; F04C 2240/56; F04C 18/10;
(Continued)

(56) References Cited

U.S. PATENT DOCUMENTS 5,165,868 A * 11/1992 Gergets ..... F04C 15/0069 417/420
2010/0166589 A1* 7/2010 Iwano ..... F04C 29/0057 418/55.1

(Continued)

FOREIGN PATENT DOCUMENTS

JP 2010-116914 A 5/2010
JP 2011-117369 A 6/2011

(Continued)

*Primary Examiner* — Mark A Laurenzi
(74) *Attorney, Agent, or Firm* — Birch, Stewart, Kolasch & Birch, LLP

(57) ABSTRACT

A pump comprises: a motor housing; a stator disposed in the motor housing; a rotor disposed in the stator; a shaft coupled to the rotor; a pump housing coupled to the motor housing; an outer gear disposed in the pump housing; an inner gear disposed within the outer gear and coupled to the shaft; a bearing housing disposed between the rotor and pump housing; and first and second bearings disposed in the bearing housing, wherein the first and second bearings have different outer diameters, and the bearing housing is arranged to at least partially overlap the rotor in a direction perpendicular to the axial direction.

16 Claims, 6 Drawing Sheets

(58) Field of Classification Search
CPC ..... F04C 18/103; F04C 18/107; F04C 2/10; F04C 2/101; F04C 2/102; F04C 2/107; F04C 15/0057; F04C 2240/40; F01C 21/02; F01C 1/10; F01C 1/102; F01C 1/103; F01C 1/107
See application file for complete search history.

(56) References Cited

U.S. PATENT DOCUMENTS

| | | | | |
|---|---|---|---|---|
| 2011/0135516 | A1 | 6/2011 | Oishi et al. | |
| 2011/0194954 | A1 | 8/2011 | Sakata et al. | |
| 2012/0128513 | A1* | 5/2012 | Sakata | F04C 2/086 417/410.1 |
| 2013/0052058 | A1* | 2/2013 | Motohashi | F01C 21/02 417/410.4 |
| 2014/0037472 | A1* | 2/2014 | Hibi | F04B 17/03 417/410.1 |
| 2019/0249661 | A1 | 8/2019 | Wang et al. | |
| 2021/0194319 | A1* | 6/2021 | Smith | H02K 29/08 |
| 2022/0120272 | A1* | 4/2022 | Lee | F04C 18/0215 |

FOREIGN PATENT DOCUMENTS

| | | | | |
|---|---|---|---|---|
| JP | 2012189015 | A | * | 10/2012 |
| JP | 2013-64395 | A | | 4/2013 |
| JP | 2021-48689 | A | | 3/2021 |
| KR | 10-2020-0120897 | A | | 10/2020 |

* cited by examiner

【FIG. 1】
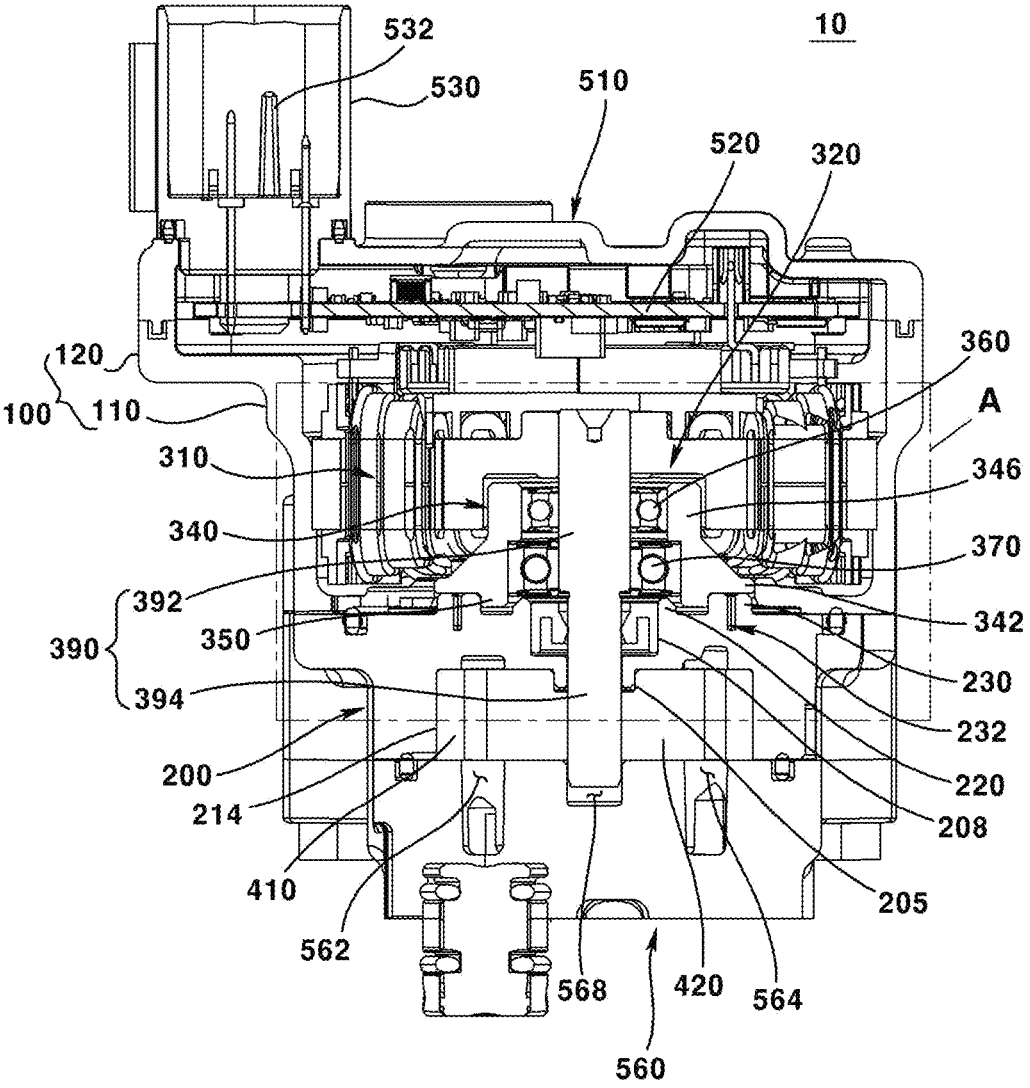

【FIG. 2】
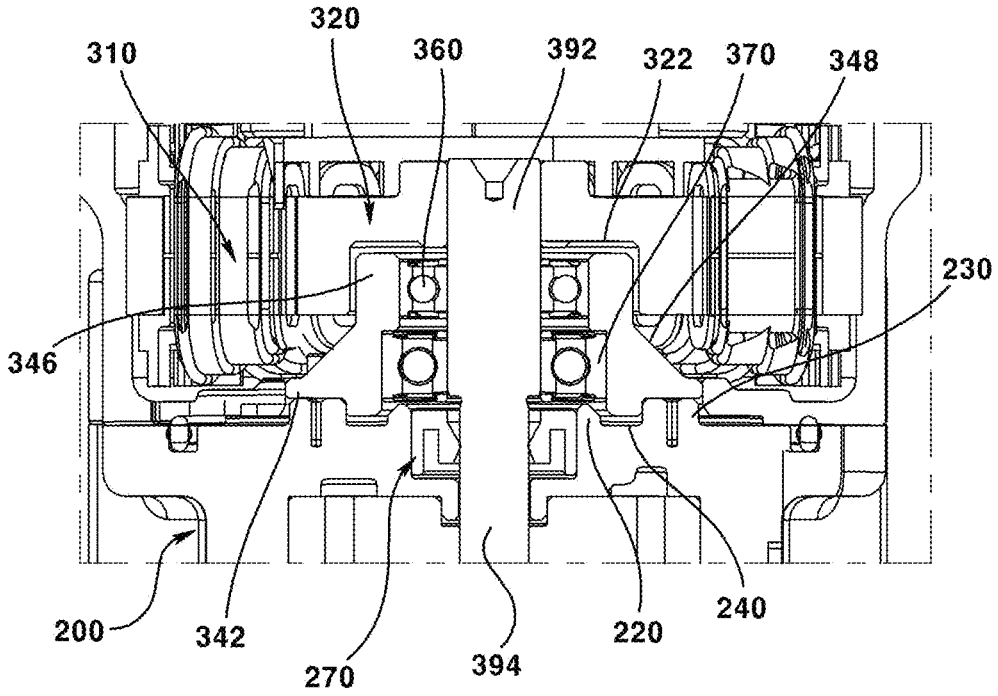

【FIG. 3】
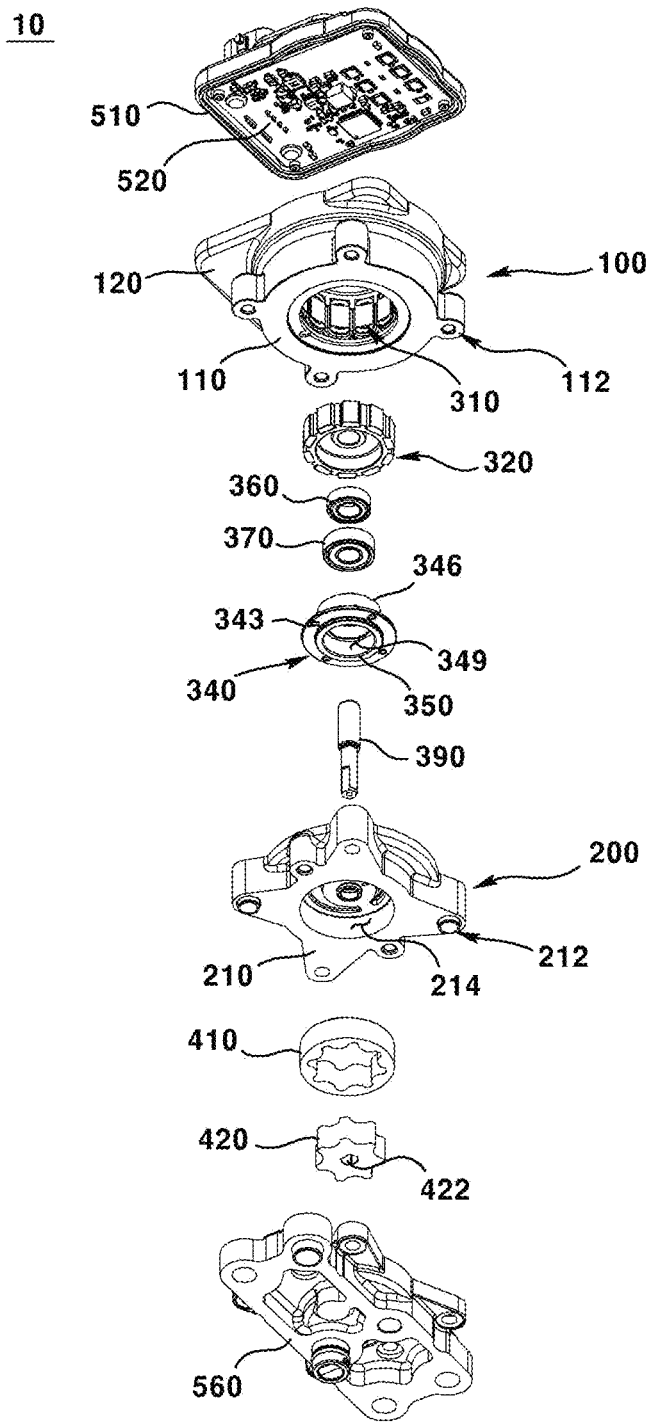

【FIG. 4】
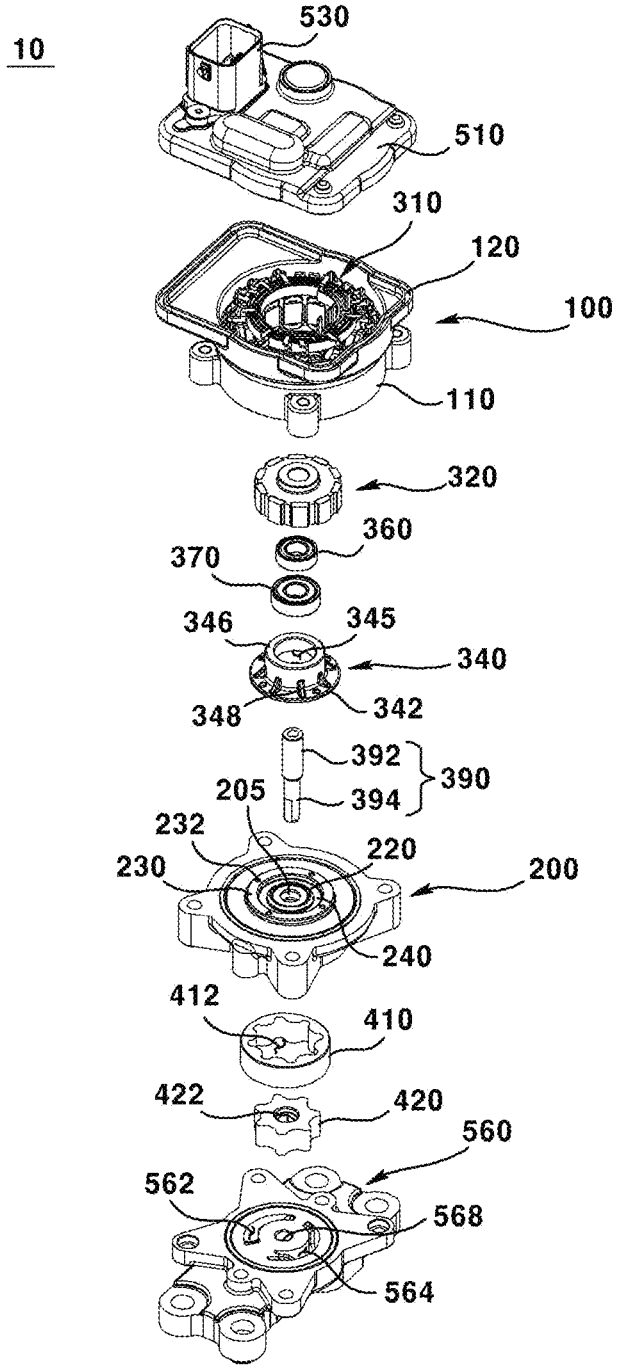

【FIG. 5】
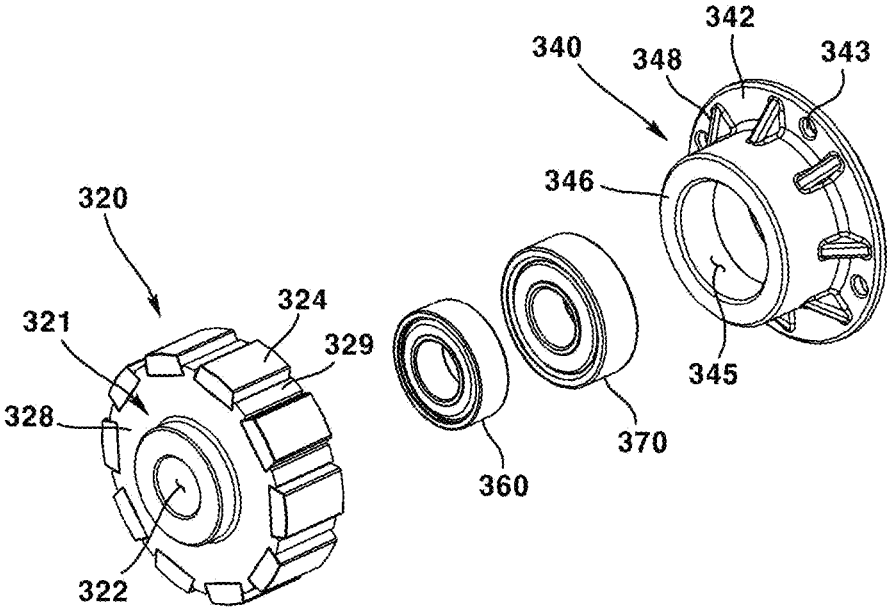
【FIG. 6】
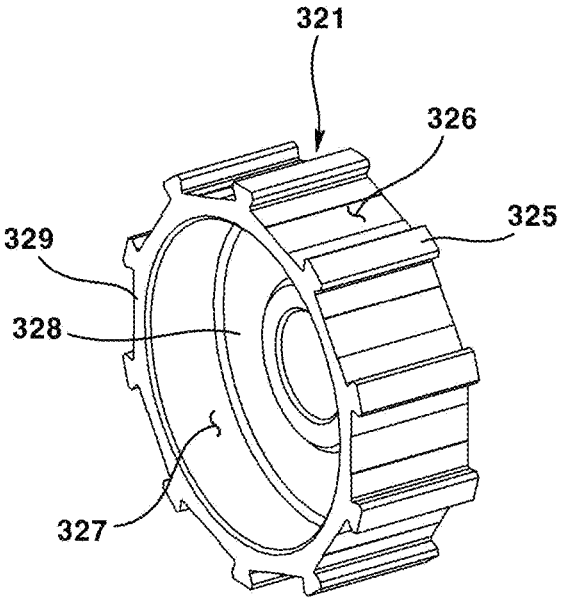

【FIG. 7】
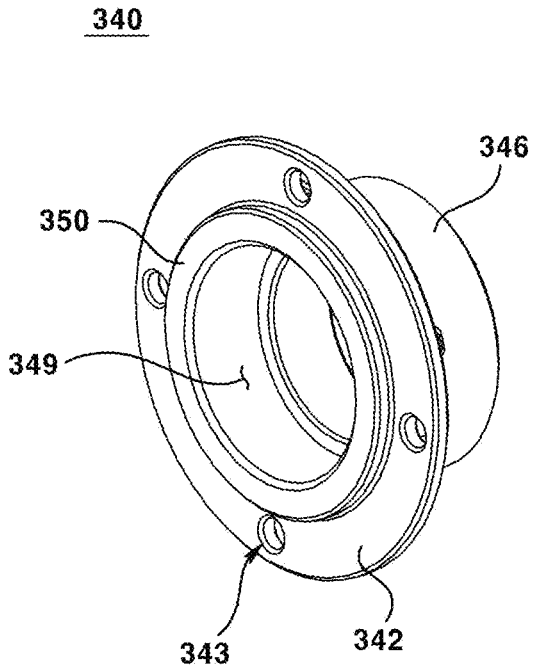

PUMP

CROSS REFERENCE TO RELATED APPLICATIONS

This application is the National Phase of PCT International Application No. PCT/KR2022/018107, filed on Nov. 16, 2022, which claims priority under 35 U.S.C. 119 (a) to Patent Application No. 10-2021-0179512, filed in the Republic of Korea on Dec. 15, 2021, all of which are hereby expressly incorporated by reference into the present application.

TECHNICAL FIELD

The teachings in accordance with exemplary and non-limiting embodiments of this invention relate generally to a pump.

BACKGROUND ARTS

The pump includes a motor region for generating rotational drive force and a pump region for generating hydraulic pressure. The motor region includes a stator, a rotor disposed within the stator, and a shaft coupled to the center of the rotor. The pump region includes an inner gear coupled to the shaft, and an outer gear disposed outside the inner gear.

However, due to the problem that the axial system of the inner gear engaged with the shaft is not stable, the rotational stability of the rotor is unstable due to the force applied at the outlet of the pump as the pressure inside the pump increases.

In particular, there is a problem that friction is generated between the plurality of housings when the axial system of the rotor is unstable in the high-pressure area, which reduces the performance and efficiency of the pump.

DETAILED DESCRIPTION OF THE INVENTION

Technical Subject

An exemplary embodiment of the present invention is to provide a pump that can improve driving efficiency by improving the structure to ensure axial system stability within the pump.

Furthermore, the present invention provides a pump that can be miniaturized by reducing its size.

Technical Solution

In one general aspect of the present invention, there may be provided a pump, comprising:

- a motor housing;
- a stator disposed in the motor housing;
- a rotor disposed in the stator;
- a shaft coupled to the rotor;
- a pump housing coupled to the motor housing;
- an outer gear disposed in the pump housing;
- an inner gear disposed within the outer gear and coupled to the shaft;
- a bearing housing disposed between the rotor and pump housing; and
- first and second bearings disposed in the bearing housing, wherein the first and second bearings have different outer diameters, and the bearing housing is arranged to at least partially overlap the rotor in a direction perpendicular to the axial direction.

Preferably, but not necessarily, with respect to the axial direction of the shaft, the first bearing and the second bearing may be spaced apart from each other.

Preferably, but not necessarily, a portion of the bearing housing and a portion of the first bearing may be disposed between the shaft and the rotor.

Preferably, but not necessarily, the bearing housing may be screwed to the pump housing.

Preferably, but not necessarily, the bearing housing may have a rib formed on a lower surface thereof that project downwardly from other areas, and the second housing may include a groove to which the rib is coupled.

Preferably, but not necessarily, the bearing housing may include a first region in which the first bearing is disposed on the inner side, and a second region in which the second bearing is disposed on the inner side, wherein the diameter of the first region may be different from the diameter of the second region.

Preferably, but not necessarily, the shaft may include an upper region having a first diameter and a lower region having a second diameter smaller than the first diameter, the upper region being disposed in the motor housing and the lower region being disposed in the pump housing.

Preferably, but not necessarily, the upper region of the shaft may be coupled within the first bearing and the second bearing.

Preferably, but not necessarily, a groove may be disposed on a lower surface of the rotor to receive at least a portion of the bearing housing.

Preferably, but not necessarily, the first bearing may be so disposed as to at least partially overlap radially with the rotor.

Advantageous Effects

The present embodiments have the advantages of forming a rotational support structure with a plurality of bearings on the outer surface of the shaft, which prevents the shaft from deviating from the axial system within the pump, thereby improving the driving efficiency of the pump in various environments.

Furthermore, a portion of the bearing housing that houses the plurality of bearings can be arranged in a superimposed direction perpendicular to the axial direction of the rotor, thereby reducing the overall size of the pump, thereby enabling miniaturization of the pump.

Furthermore, by compactly arranging bearings of different sizes in a single housing in an axial direction, it is possible to prevent any of the bearings from being dislodged or separated from the shaft during operation.

BRIEF DESCRIPTION OF THE DRAWINGS

FIG. 1 is a cross-sectional view of a pump according to an exemplary embodiment of the present invention.

FIG. 2 is an enlarged view of A of FIG. 1.

FIG. 3 is an exploded perspective view of a pump according to an exemplary embodiment of the present invention.

FIG. 4 is a drawing showing FIG. 3 from a different angle.

FIG. 5 is an exploded perspective view of a rotor, bearing housing and bearing according to an exemplary embodiment of the present invention.

FIG. 6 is a perspective view of a rotor according to an exemplary embodiment of the present invention.

FIG. 7 is a perspective view of a bearing housing according to an exemplary embodiment of the present invention.

BEST MODE

Hereinafter, exemplary embodiments of the present invention will be described in detail with reference to the accompanying drawings.

However, it should be noted that the technical ideas of the present invention should not be construed as limited to some of the explained exemplary embodiments but may be embodied in mutually different various shapes, and one or more elements may be selectively coupled or substituted among exemplary embodiments as long as within the scope of technical concept of the present invention.

Furthermore, terms (including technical and scientific terms) used in the embodiments of the present invention, unless expressly specifically defined and described, are to be interpreted in the sense in which they would be understood by a person of ordinary skill in the art to which the present invention belongs, and commonly used terms, such as dictionary-defined terms, are to be interpreted in light of their contextual meaning in the relevant art.

Furthermore, the terms used in the embodiments of the invention are intended to describe the embodiments and are not intended to limit the invention.

In this specification, the singular may include the plural unless the context otherwise requires, and references to "at least one (or more) of A and (or) B and C" may include one or more of any combination of A, B, and C that may be assembled.

In addition, the terms first, second, A, B, (a), (b), and the like may be used to describe components of embodiments of the invention. Such terms are intended only to distinguish one component from another, and are not intended to limit the nature or sequence or order of such components by such terms.

Furthermore, when a component is described as "connected," "coupled," or "attached" to another component, it can include cases where the component is "connected," "coupled," or "attached" to the other component directly, as well as cases where the component is "connected," "coupled," or "attached" to another component that is between the component and the other component.

Furthermore, when described as being formed or disposed "above" or "below" each component, "above" or "below" includes not only when two components are in direct contact with each other, but also when one or more other components are formed or disposed between the two components. Furthermore, when expressed as "above" or "below", it may include the meaning of upward as well as downward with respect to a single component.

As used herein, "axial direction" may be defined as the longitudinal direction of the shaft.

As used herein, "radial direction" may be defined as the direction perpendicular to the "axial direction" described above.

As used herein, "circumferential direction" may be defined as the circumferential direction of any one of the stator, rotor, outer gear, and inner gear, or the circumferential direction of a region forming an imaginary concentric circle with the circumferential direction of any one of the stator, outer gear, and inner gear.

FIG. 1 is a cross-sectional view of a pump according to an exemplary embodiment of the present invention, FIG. 2 is an enlarged view of A of FIG. 1, FIG. 3 is an exploded perspective view of a pump according to an exemplary embodiment of the present invention, FIG. 4 is a drawing showing FIG. 3 from a different angle, FIG. 5 is an exploded perspective view of a rotor, bearing housing and bearing according to an exemplary embodiment of the present invention, FIG. 6 is a perspective view of a rotor according to an exemplary embodiment of the present invention, and FIG. 7 is a perspective view of a bearing housing according to an exemplary embodiment of the present invention.

Referring to FIGS. 1 to 7, a pump (10) according to an exemplary embodiment of the present invention may be shaped by the combination of a first housing (100), a second housing (200), a first cover (510) and a second cover (560). The first housing (100), the second housing (200), the first cover (510), and the second cover (560) may be coupled in an upward or downward direction.

The first housing (100) may be referred to as a motor housing. The first housing (100) may include an upper region (120) and a lower region (110). The upper region (120) and the lower region (110) may be disposed in an up-down direction. The upper region (120) may be formed as an oblong shape in cross-section and may have an upwardly open upper surface. The lower region (110) may be circular in cross-section, and may open downwardly at a bottom surface.

Within the first housing (100), a stator (310), a rotor (320), and a shaft (390) may be disposed.

The stator (310) may be disposed within the first housing (100). The stator (310) may include a stator core, an insulator surrounding an outer surface of the stator core, and a coil wound on the insulator.

The rotor (320) may be disposed within the stator (310). The rotor (320) may be shaped by a rotor core (321). The rotor core (321) may include an upper surface portion (328), as shown in FIGS. 5 and 6, and side portions (329) extending downwardly from an edge of the upper surface portion (328). On the lower surface of the rotor core (321) may be formed a groove (327) into which a bearing housing (340), to be described later, is coupled. The groove (327) may have an inner circumferential surface formed by an inner surface of the side portion (329) and a bottom surface formed by a lower surface of the upper surface portion (328).

In the center of the upper surface portion (328), a hole (322) may be formed into which the shaft (390) is coupled. On the outer surface of the side portion (329), there may be formed a magnet coupling portion (326) to which the magnet (324) is coupled, and a magnet support portion (325) that protrudes outwardly from the other regions to support the sides of the magnet (324). The magnet coupling portion (326) may have a grooved shape, to which the magnet (324) may be coupled. The magnet coupling portion (326) and the magnet support portion (325) may each be provided in plurality, and may be arranged alternately along the circumferential direction of the rotor (320). An outer surface of the magnet (324) may protrude outwardly from an outer surface of the magnet support (325). Electromagnetic interaction of the magnet (324) with the coils may cause the rotor (320) and the shaft (390) to rotate together.

The shaft (390) may be coupled to the center of the rotor (320). The shaft (390) may be partially disposed within the first housing (100) and partially disposed within the second housing (200). The shaft (390) may include a plurality of regions of different diameters. The shaft (390) may include an upper region (392) having a first diameter, and a lower region (394) having a second diameter smaller than the first diameter. The lower region (394) may be disposed downstream of the upper region (392). The upper region (392)

may be disposed within the first housing (100). The lower region (394) may be disposed within the second housing (200).

The first cover (510) may be disposed to cover an upper surface of the first housing (100). Within the first cover (510), a printed circuit board (520) may be disposed. The printed circuit board (520) may be electrically connected to the coil and may control the pump (10). An upper surface of the first cover (510) may be provided with a connector ejector (530) that protrudes upwardly above other areas and has a connector (532) disposed therein. When an external terminal is coupled to the connector ejector (530), control commands may be sent to, received from, or power may be provided to the pump (10).

The second housing (200) may be coupled to the lower surface of the first housing (100). The second housing (200) may be referred to as a pump housing. The second housing (200) may be screwedly coupled to the first housing (100). For this purpose, a plurality of radially protruding first coupling portions (112) may be disposed on the lower surface of the first housing (100), and a second coupling portion (212) may be disposed on the upper surface of the second housing (200), which radially protrudes and faces the first coupling portion (112). The first coupling portion (112) and the second coupling portion (212) may each include a threaded hole, and a screw may be screwed into the threaded hole to mutually couple the first housing (100) and the second housing (200).

A sealing member for sealing may be disposed between the first housing (100) and the second housing (200).

A first protrusion (220), a second protrusion (230), and a groove (240) may be formed on the upper surface of the second housing (200). Furthermore, a hole (205) through which the shaft (390) passes may be formed on the upper surface of the second housing (200).

The first protrusion (220) may be shaped to protrude upwardly from the upper surface of the second housing (200). The first protrusion (220) may be circular in cross-section. The first protrusion (220) may support a lower surface of the second bearing (370) to be described later. The upper surface of the first protrusion (220) may be in contact with the lower surface of the outer ring of the second bearing (370).

The second protrusion (230) may be disposed on an outer side of the first protrusion (220). The second protrusion (230) may be shaped to protrude upwardly from the upper surface of the second housing (200). The second protrusion (230) may be circular in cross-section. The second protrusion (230) may support a lower surface of the bearing housing (340) to be described later. A first threaded hole (232) may be formed on the upper surface of the second protrusion (230).

The first threaded holes (232) may be provided in plurality and spaced apart from each other along the circumferential direction of the second protrusion (230). The lower surface of the bearing housing (340) may be screwed onto the second protrusion (230) via a screw that is screwed into the first threaded hole (232). The surface of the bearing housing (340) that is coupled with the second protrusion (230) may have a groove shape that is recessed upwardly from other areas.

The groove (240) may be disposed between the first protrusion (220) and the second protrusion (230). The groove (240) may have a circular cross-sectional shape. A bottom surface of the groove (240) may be defined by an upper surface of the second housing (200). The groove 240 may be coupled with the rib (350) of the bearing housing (340), which will be described later.

A guide hole (208) may be formed in the upper surface of the second housing (200). The guide hole (208) may be disposed on an upper side of the hole (205) through which the shaft (390) penetrates. The cross-sectional area of the guide hole (208) may be formed larger than the cross-sectional area of the hole (205). A guide may be disposed in the guide hole (208), and the guide may support an outer surface of the shaft (390). The guide may support an outer surface of a lower region (394) within the shaft (390).

A space (214) may be formed on the lower surface of the second housing (200). The space (214) may have the shape of a groove recessed upwardly into the center of the lower surface of the second housing (200). In the space (214) of the second housing (200), the outer gear (410) and the inner gear (420) may be disposed.

The outer gear (410) may be disposed within the second housing (200). In the center of the outer gear (410), a hole 412 may be formed in which the inner gear (420) is disposed. On the inner circumferential surface of the hole (412), a plurality of mountain portions protruding inwardly from the inner circumferential surface may be formed, and a valley portion disposed between the plurality of mountain portions may be formed. In summary, on the inner surface of the hole (412), a first gear may be formed in which the plurality of mountain portions and the plurality of valley portions are disposed alternately.

The inner gear (420) may be disposed on an inner side of the outer gear (410). The inner gear (420) and the outer gear (410) may be disposed so that their centers do not coincide with each other. An outer circumferential surface of the inner gear (420) may be formed with a plurality of mountain portions protruding outwardly from the outer circumferential surface, and a valley portion disposed between the plurality of mountain portions, i.e., a second gear may be formed on the outer circumferential surface of the inner gear (420) in which the plurality of mountain portions and the plurality of valley portions are disposed alternately.

In the center of the inner gear (420), a hole (422) may be formed. In the hole (422), a shaft (390) may be coupled. In the hole (422), a lower region (394) of the shaft (390) may be coupled. Thus, the inner gear (420) may rotate with the shaft (390) upon rotation of the shaft (390).

A second cover (560) may be coupled to the lower surface of the second housing (200). The second cover (560) may be coupled to cover the lower surface of the second housing (200). The second cover (560) may be arranged to cover a space (214) within the second housing (200). The second cover (560) may be screwed to the second housing (200). A sealing member for sealing may be disposed between the second cover (560) and the second housing (200).

On the upper surface of the second cover (560) facing the second housing (200), a first opening (562) through which fluid is sucked in and a second opening (564) through which circulated fluid is discharged may be formed. A third opening connected to the first opening (562) and a fourth opening connected to the second opening (564) may be formed on the lower surface of the second cover (560). Here, the fluid may be an oil. The first opening (562) and the second opening (564) may each be formed to have an arc shape, and may be arranged to be spaced apart in an increasingly narrow manner from one side to the other. More specifically, the wider spaced side of the first opening (562) may be arranged to face the wider spaced side of the second opening (564), and the narrower spaced side of the second opening (564) may be arranged to face the narrower spaced side of the first opening (562).

A hole (568) may be formed in the center of the upper surface of the second cover (560). In the hole (568), a lower end of the shaft (390) may be coupled. The hole (568) may be arranged axially opposite the hole (422) of the inner gear (420) and the hole (205) of the second housing (200).

The pump (10) may include a bearing housing (340). The bearing housing (340) may be disposed between the first housing (100) and the second housing (200). The bearing housing (340) may be disposed at least partially within the first housing (100). The bearing housing (340) may be disposed between the rotor (320) and the second housing (200).

The bearing housing (340) may include a first region (346) and a second region (342). The second region (342) may be disposed at a lower portion of the first region (346). A first space (346) of a first inner diameter may be formed on an inner side of the first region (346), and a second space (349) of a second inner diameter larger than the first inner diameter may be formed on an inner side of the second region (342). The first region (346) and the second region (342) may each have a circular cross-section, and the first region (346) may have a shape that protrudes upwardly from the upper surface of the second region (342). The cross-sectional area of the first region (346) may be formed smaller than the cross-sectional area of the second region (342). The second region (342) may have a plate shape.

The first region (346) may be coupled to a groove (327) formed on the lower surface of the rotor (320). At least a portion of the first region (346) may be received within the groove (327). At least a portion of the first region (346) may be arranged to radially overlap the rotor (320). Accordingly, a portion of the bearing housing (340) and a portion of the first bearing (360) may be disposed between the shaft (390) and the rotor (320) in a radial direction.

A reinforcing rib (348) may be disposed on the outer surface of the bearing housing (340). The reinforcing rib (348) may be disposed on the outer peripheral surface of the second region (342) at one end and on the upper surface of the first region (342) at the other end. The outer surface of the reinforcing rib (348) may be inclined such that the length of the projection from the outer surface of the second region (342) increases downwardly. Through the reinforcing rib (348), the strength of the bearing housing (340) may be increased.

The second region (342) may include a second threaded hole (343). The second threaded hole (343) may be shaped to penetrate downwardly from an upper surface of the second region (342). The second threaded holes (343) may be plural and spaced apart from each other along the circumferential direction of the second region (342). The second threaded holes (343) may be arranged to face the first threaded holes (232) of the second housing (200) 13 in an upward and downward direction. Thus, by screwing a screw through the second threaded hole (343) and into the first threaded hole (232), the bearing housing (340) may be screwed to the upper surface of the second housing (200).

A rib (350) may be formed on the lower surface of the second region (342) that protrudes downwardly from the other regions. The rib (350) may have a circular cross-sectional shape. The rib 350 may be coupled into a groove (240) formed in the upper surface of the second housing (200).

The pump (10) may include a plurality of bearings. The plurality of bearings may include a first bearing (360) disposed in the first space (346) and a second bearing (370) disposed in the second space (349). The first bearing (360) and the second bearing (370) may each be coupled to an outer surface of the shaft (390) to support rotation of the shaft (390). The plurality of bearings may be ball bearings in which balls are disposed between the outer and inner rings. The first bearing (360) and the second bearing (370) may be spaced apart from each other along the axial direction.

The first bearing (360) may be disposed in the first space (346). In the center of the first bearing (360), a hole may be formed through which the shaft (390) passes. The shaft (390) may be pressed into the hole in the first bearing (360). The first bearing (360) may include an inner ring, an outer ring, and a ball disposed between the inner ring and the outer ring.

The second bearing (370) may be disposed in a second space (349). In the center of the second bearing (370), a hole may be formed through which the shaft (390) passes. The shaft (390) may be pressed into the hole in the second bearing (370). The second bearing (370) may include an inner ring, an outer ring, and a ball disposed between the inner ring and the outer ring. The lower surface of the outer ring of the second bearing (370) may be supported by the upper surface of the first protrusion (220) of the second housing (200). The upper surface of the outer ring of the second bearing (380) may be in contact with the lower surface of the first region (346).

Meanwhile, the region of the shaft (390) that is coupled to the first bearing (360) and the second bearing (370) may be an upper region (392).

The first bearing (360) and the second bearing (370) may be formed with different cross-sectional areas. The cross-sectional area of the first bearing (360) may correspond to the cross-sectional area of the first space (346). The cross-sectional area of the second bearing (370) may correspond to the cross-sectional area of the second space (349). Accordingly, the outer diameters of the first bearing (360) and the second bearing (370) may be different from each other. Specifically, the outer diameter of the first bearing (360) may be smaller than the outer diameter of the second bearing (370).

The size of the ball disposed in the first bearing (360) and the size of the ball disposed in the second bearing (370) may be different. In one example, the diameter of the ball disposed in the first bearing (360) may be smaller than the diameter of the ball disposed in the second bearing (370).

According to the structure as described above, it is advantageous to form a rotational support structure with a plurality of bearings on the outer surface of the shaft (390), which can prevent the axial system of the shaft (390) from deviating within the pump, thereby improving the drive efficiency of the pump in various environments.

Furthermore, it is advantageous that a portion of the bearing housing (340) that houses a plurality of bearings can be overlapped in an axially perpendicular direction with the rotor (320) to thereby reduce the overall size, thereby enabling the pump to be miniaturized.

It is also advantageous that bearings of different sizes can be compactly arranged axially in a single housing, thereby preventing any one bearing from being dislodged or separated from the shaft during operation.

Although all of the components comprising embodiments of the present invention have been described above as being combined or operating in combination, the invention is not necessarily limited to these embodiments, i.e., all of the components may optionally be combined in one or more combinations, as long as they are within the scope of the present invention. Furthermore, the terms "comprising," "consisting of," "consisting of," or "having" as used herein should be interpreted to mean that the component in question may be inherent in, rather than excluding, other components, unless the contrary is specifically indicated. All terms, including technical or scientific terms, unless otherwise defined, shall have the same meaning as commonly understood by one having ordinary knowledge in the technical field to which the invention belongs. Commonly used terms, such as dictionary-defined terms, are to be interpreted as consistent with their contextual meaning in the relevant art and are not to be construed in an idealized or unduly formal sense unless expressly defined in the present invention.

The above description is merely an exemplary description of the technical ideas of the invention, and various modifications and variations will be apparent to one having ordinary knowledge in the technical field to which the invention belongs without departing from the essential features of the invention. Accordingly, the embodiments disclosed herein are intended to illustrate, not to limit, the technical ideas of the invention, and the scope of the technical ideas of the invention is not limited by these embodiments. The scope of protection of the invention shall be construed in accordance with the following claims, and all technical ideas within the scope thereof shall be construed as falling within the scope of the invention.

The invention claimed is:

1. A pump comprising:

a motor housing;

a stator disposed in the motor housing;

a rotor disposed in the stator;

a shaft coupled to the rotor;

a pump housing coupled to the motor housing;

an outer gear disposed in the pump housing;

an inner gear disposed within the outer gear and coupled to the shaft;

a bearing housing disposed between the rotor and the pump housing; and a first bearing and a second bearing disposed in the bearing housing, wherein a first groove is disposed on a lower surface of the rotor, the first groove being configured to receive at least a portion of the bearing housing, wherein the bearing housing includes a first receiving portion coupled to the first groove of the rotor, and a second receiving portion arranged on an outer side of the first groove and having one surface coupled to the pump housing, wherein an outer surface of the second receiving portion has an inclined surface having a shape in which a cross-sectional area of the second receiving portion increases as the second receiving portion approaches the pump housing, wherein the first bearing is disposed in the first receiving portion, wherein the second bearing is disposed in the second receiving portion, wherein a cross-sectional area of the shaft coupled to the first bearing, the second bearing, and the bearing housing is larger than a cross-sectional area of the shaft coupled to the pump housing, wherein an outer diameter of the second bearing is larger than an outer diameter of the first bearing, wherein a maximum outer diameter of the second receiving portion is larger than an outer diameter of the rotor, wherein the inner gear includes a hole adjacent to the shaft, wherein the pump housing is located in the hole of the inner gear, and wherein the bearing housing includes a portion located above the first bearing and the second bearing and a portion located below first bearing and the second bearing.

2. The pump of claim 1, wherein a portion of the bearing housing and a portion of the first bearing are disposed between the shaft and the rotor.

3. The pump of claim 1, wherein the bearing housing is screwed to the pump housing.

4. The pump of claim 1, wherein the bearing housing has a rib formed on a lower surface thereof that projects downwardly, and the pump housing includes a second groove to which the rib is coupled.

5. The pump of claim 1, wherein the bearing housing includes a reinforcing rib having a first end coupled to an outer surface of the first receiving portion and a second end coupled to the outer surface of the second receiving portion.

6. The pump of claim 1, wherein the shaft includes an upper region having a first diameter and a lower region having a second diameter smaller than the first diameter, wherein the upper region is disposed in the motor housing, and wherein the lower region is disposed in the pump housing.

7. The pump of claim 6, wherein the upper region of the shaft is coupled within the first bearing and the second bearing.

8. The pump of claim 1, wherein an outer ring of the second bearing contacts a lower surface of the first receiving portion.

9. The pump of claim 1, wherein a second protrusion protrudes from an upper surface of the pump housing, and wherein the second protrusion is screwed to a lower surface of the second receiving portion.

10. The pump of claim 1, further comprising:

a first cover that is coupled to an upper surface of the motor housing and has a printed circuit board disposed on an inside, and a sealing member disposed between the motor housing and the pump housing.

11. The pump of claim 1, wherein a first protrusion protrudes from an upper surface of the pump housing, and wherein an upper surface of the first protrusion supports an outer ring of the second bearing.

12. The pump of claim 1, wherein the first bearing and the second bearing each include an inner ring, an outer ring, and a ball disposed between the inner ring and the outer ring, and wherein sizes of the ball of the first bearing and the ball of the second bearing are different from each other.

13. The pump of claim 1, wherein an inner diameter of the first bearing is approximately equal to an inner diameter of the second bearing.

14. The pump of claim 1, wherein the rotor overlaps the first bearing in a horizontal direction and does not overlap the second bearing in the horizontal direction.

15. The pump of claim 1, wherein the pump housing is located between the bearing housing and the inner gear and outer gear.

16. The pump of claim 1, wherein the pump housing contacts the second bearing.

* * * * *